US011298961B1

(12) United States Patent
Baharal et al.

(10) Patent No.: US 11,298,961 B1
(45) Date of Patent: Apr. 12, 2022

(54) GARMENT PRINTING PALLET

(71) Applicant: Kornit Digital Ltd., Rosh HaAyin (IL)

(72) Inventors: Amit Baharal, RaAnana (IL); Hasan Shriem, Taybe (IL); Gerald David, Tel Mond (IL)

(73) Assignee: Kornit Digital Ltd., Rosh HaAyin (IL)

( * ) Notice: Subject to any disclaimer, the term of this patent is extended or adjusted under 35 U.S.C. 154(b) by 0 days.

(21) Appl. No.: 17/065,578

(22) Filed: Oct. 8, 2020

(51) Int. Cl.
*B41J 11/06* (2006.01)
*B41F 15/22* (2006.01)
*B41J 3/407* (2006.01)

(52) U.S. Cl.
CPC ..... *B41J 11/06* (2013.01); *B41F 15/22* (2013.01); *B41J 3/4078* (2013.01)

(58) Field of Classification Search
CPC ..... B41J 11/06
USPC ..... 101/35
See application file for complete search history.

(56) References Cited

U.S. PATENT DOCUMENTS 4,909,146 A * 3/1990 Szarka ..... B41F 15/0863 101/126
5,327,827 A * 7/1994 Richardson ..... B41F 15/22 100/233
5,640,905 A * 6/1997 Szyszko ..... B41F 15/0863 101/114
5,765,476 A * 6/1998 McKeever ..... B41F 15/36 101/127.1
5,771,801 A * 6/1998 Newman ..... B41F 15/10 101/127.1
5,775,221 A * 7/1998 Bill ..... B41F 15/0895 101/127.1
6,640,714 B1 * 11/2003 Papa ..... B41F 15/0863 101/126
10,875,291 B2 * 12/2020 Hoffman, Jr. ..... B41F 15/26

* cited by examiner

*Primary Examiner* — Anthony H Nguyen

(57) ABSTRACT

A pallet for holding garments during printing comprises a base and a frame pivotally attached to the base, to hold a garment in a space between the base and the frame, the frame being locked onto the base over the garment to define the space. The pallet comprises a primary locking mechanism to lock the frame into a first position defining a relatively small space for a thin garment and a secondary locking mechanism for locking the frame into a second position defining a relatively large space for thicker garments, thereby providing a single pallet that can accommodate garments of a larger range of thicknesses, for example t-shirts and sweaters or hoodies.

11 Claims, 9 Drawing Sheets

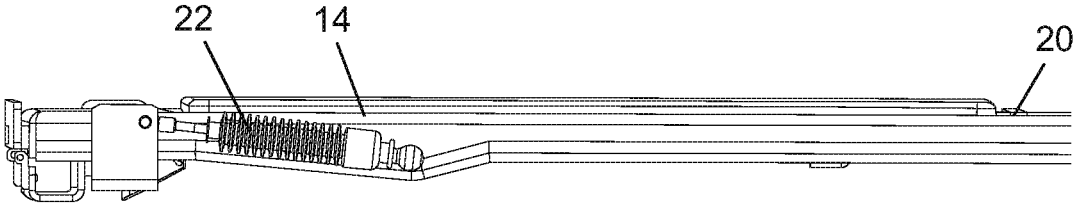
Fig. 3 - Prior Art
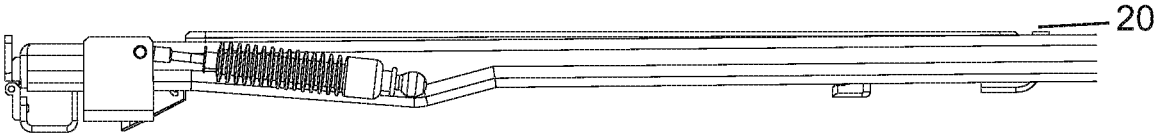
Fig. 4 Prior Art

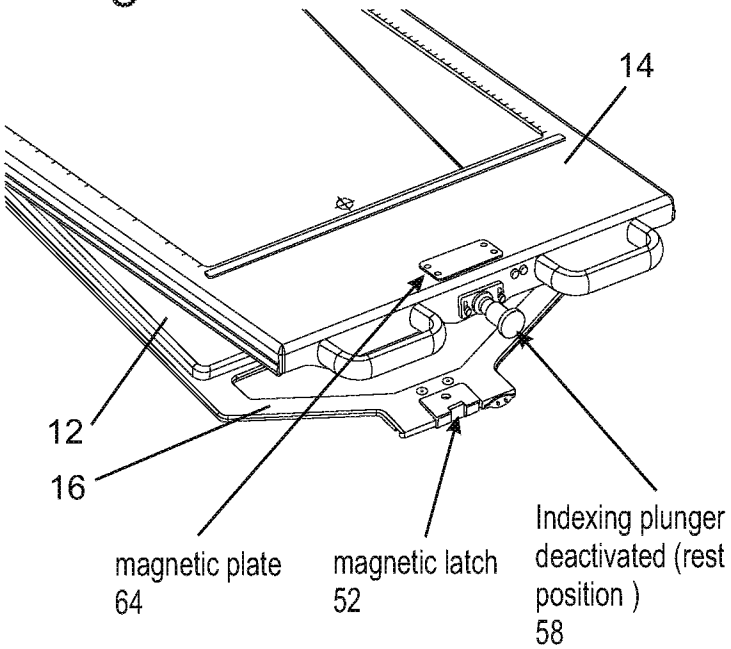
Fig. 7
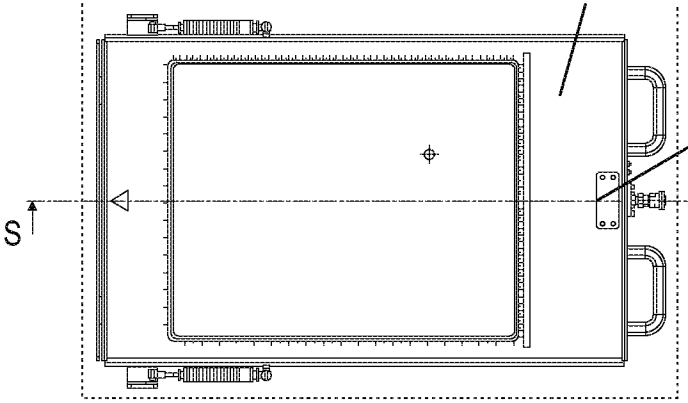
Fig. 6
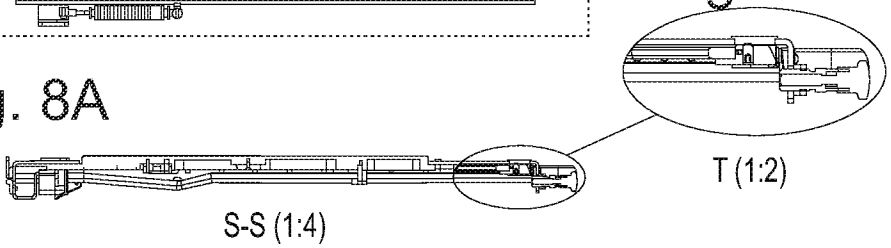
Fig. 8B
Fig. 8A
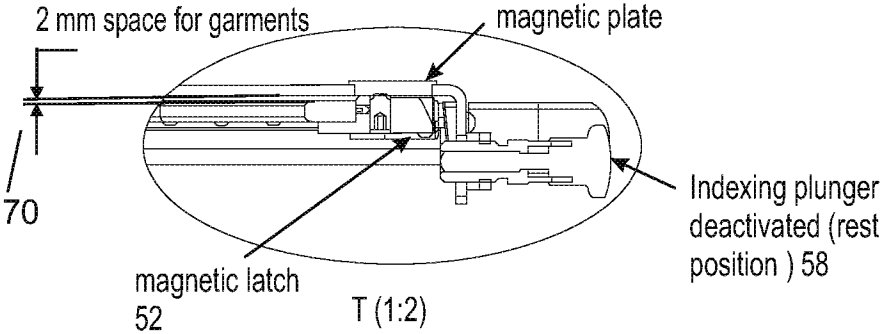
Fig. 8C

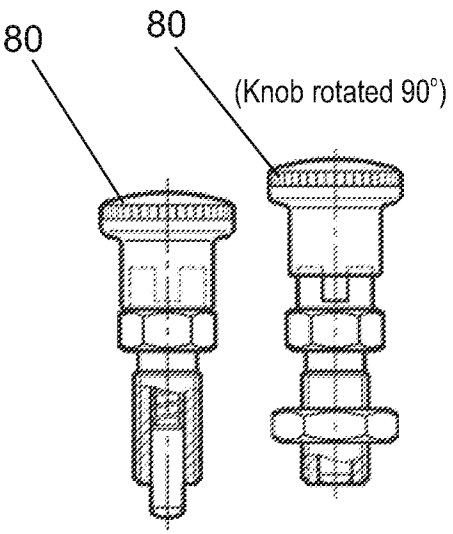
Fig. 12B
Fig. 12C
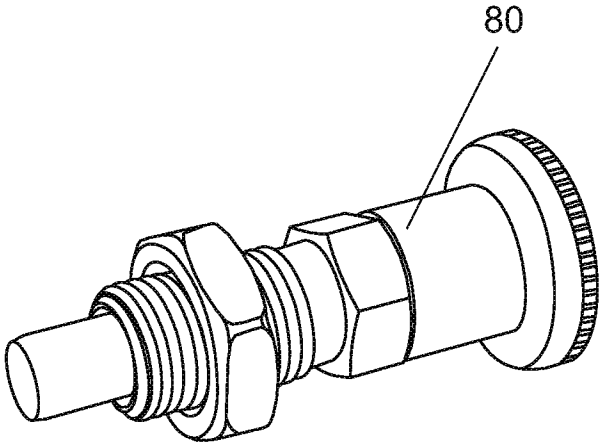
Fig. 12A

GARMENT PRINTING PALLET

FIELD AND BACKGROUND OF THE INVENTION

The present invention, in some embodiments thereof, relates to a pallet for holding garments for printing and, more particularly, but not exclusively, to a pallet for use when printing garments of different thicknesses.

Garments need to be held tightly for printing. If the garment is not held tightly then movement can smear out the printing, and wrinkles can block print nozzles. Thus the pallet carrying the garment has to hold the garment at the edges and close firmly over the garment. The pallet then has to lock over the garment so that it does not swing open during printing, which would cause damage to the printing apparatus.

Now not all garments are made of the same material. Sweaters, hoodies and coats are considerably thicker than shirts and t-shirts. Thus different pallets are used for the different garments, each pallet being designed for a given thickness range. If the garment is too thin for the pallet then the garment is too loosely held and is able to move or form wrinkles. If the garment is too thick for the pallet then the pallet cannot lock closed. Hence it is important that the correct pallet is used for the garment being printed.

In many cases only one sort of garment is printed, so that only a single pallet is needed. But in cases where a range of thicknesses are printed, multiple pallets are provided and the operator has to change the pallet manually. The additional pallets are an extra cost for the printing machine, and indeed are generally quite large, so as to accommodate adult sized garments, hence comprising a large amount of metal which means they may be quite heavy, often at the limits of what a typical machine operator can manage, so that manual changeover of the printing pallet is probably the hardest operation that the operator carries out.

It is noted that relatively small differences in thickness of the same type of garment can usually be accommodated with a single pallet, since textiles are compressible to a certain extent. Hence the issue only arises when significantly different thicknesses are involved as found in different types of garment, say t-shirts and swim suits as against sweaters or hoodies, and a third category being winter coats.

Hence it would be desirable to have a way of printing garments of different thicknesses without having to change the pallet each time.

SUMMARY OF THE INVENTION

Embodiments of the present invention may provide a pallet with an auxiliary locking mechanism that allows a pallet designed for a relatively thin garment to be locked at a wider position using the auxiliary locking mechanism when printing a relatively thicker garment. The pallet reaches a suitably tight position with the thicker garment in the pallet, but this is a position that falls short of or is too wide for, the main lock. Then the auxiliary locking mechanism is engaged and the pallet is locked to firmly hold the thicker garment in position, even though the pallet could not be considered closed and could not be locked in such a wide position with the primary locking mechanism.

According to an aspect of some embodiments of the present invention there is provided a pallet for holding garments during printing, the pallet comprising a base and a frame pivotally attached to said base, to hold a garment in a space between said base and said frame, said frame being locked onto said base over said garment to define said space, the pallet comprising a first locking mechanism to lock the frame into a first position defining a first sizing of said space and a secondary locking mechanism for locking the frame into a second position defining a second sizing of said space, thereby allowing for accommodation of garments of different thicknesses.

In an embodiment, said first locking mechanism and said secondary locking mechanism are used as alternatives.

In an embodiment, said first locking mechanism comprises a magnetic latch and said secondary locking mechanism comprises a lever.

In an embodiment, the lever has a rest position and an active position.

In an embodiment, said lever is located on one member of the group comprising said frame and said base, said lever being configured to engage a corresponding groove in a second member of said group only when in said active position.

In an embodiment, said lever is configured to change between said active and said rest position by rotation.

In an embodiment, said lever is configured to change between said active and said rest position by guidance through a shaped groove.

In an embodiment, said first sized space is under 3 mm and said second sized space is over 3 mm.

In an embodiment, said first sized space is suitable for t-shirts and said second sized space is suitable for sweaters and hoodies.

Embodiments may comprise a fail-safe locking sensor for detecting whether said pallet is locked to prevent an unlocked pallet from entering a printing area, the fail-safe locking sensor having a first sensing mechanism for sensing a state of said first locking mechanism and a second sensing mechanism for sensing a state of said secondary locking mechanism, and an OR gate for allowing said entering a printing area when either one of said first and secondary locking mechanisms is engaged.

Embodiments may comprise hinges for said pivotal attachment of said base to said frame, said hinges being mounted on adjustable mounts.

In an embodiment, said secondary mechanism comprises a plurality of locking positions.

According to a second aspect of the present invention there is provided a method of fitting a garment on a pallet for printing, the pallet having a base, and a frame that fits over the base to close the garment onto the base with a surface of the garment exposed within the frame for printing, the frame then being locked to the base to hold the garment firmly for said printing, the method comprising:

Placing the garment on the base;

Closing the frame over the garment and if the frame reaches a predetermined first locking position on the base then locking the frame at said first predetermined locking position, but if the garment thickness does not allow for the frame to reach said first predetermined position then locking the frame at a second locking position.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings:

FIG. 3 is a side view of a known pallet, closed over a thin garment;

FIG. 4 is a side view of a known pallet, where a thick garment prevents the pallet from closing;

FIGS. 6, 7 and 8A-8C are different views showing operation of the primary locking mechanism of the pallet of FIG. 5;

FIGS. 12A-12C are three different views of an indexing plunger as used in the embodiment of FIG. 5.

DESCRIPTION OF SPECIFIC EMBODIMENTS OF THE INVENTION

The present embodiments may provide a pallet for holding garments for printing that is able to accommodate garments of varying degrees of thickness, by adding an auxiliary locking mechanism.

The auxiliary locking mechanism allows for the pallet to be closed and locked over the garment selected for printing and placed in the pallet even when the garment thickness prevents the pallet from reaching the normal pallet closure position. Such an event happens if the garment in the pallet is significantly thicker than the thickness the pallet was designed for and hence not fitting in the space that the pallet was designed to provide.

With the auxiliary locking mechanism, a pallet is thus provided that is suitable for any expected thickness of garment. Typically the pallet is built for the thinnest range of garments and then one or more gradations of auxiliary locking mechanisms allow for the pallet to accommodate thicker ranges of garments, so that a single pallet may for example accommodate anything from thin summer shirts to thick winter coats.

For purposes of better understanding some embodiments of the present invention, reference is first made to the construction and operation of a known printing pallet as illustrated in FIGS. 1-4.

Figure 1:
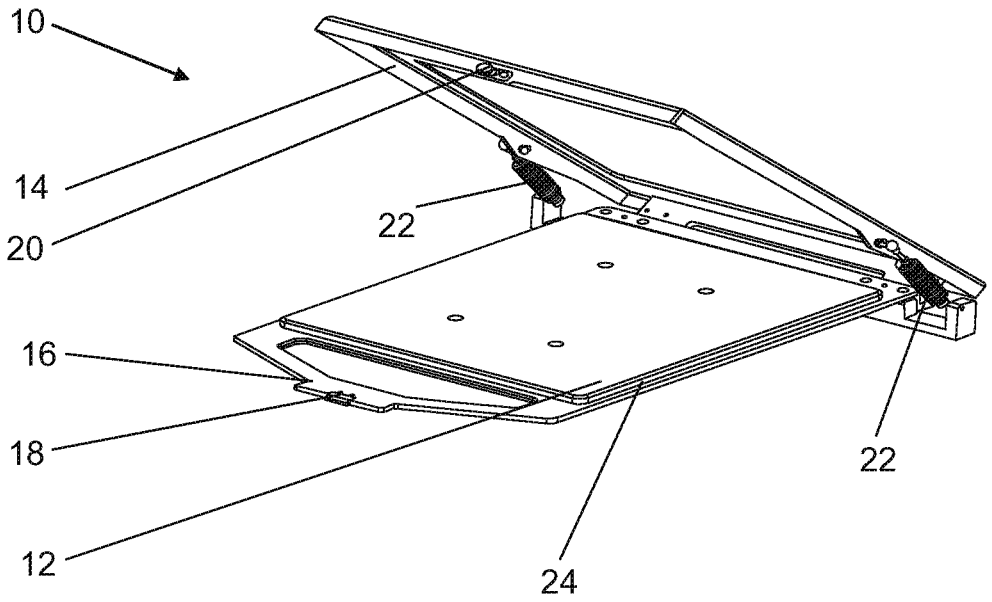
Fig. 1 Prior Art
FIG. 1 is a schematic diagram of a known pallet for holding garments during printing, shown in the open position.

FIG. 1 illustrates a known printing pallet 10 in the open position. A base part 12 is connected via a hinge with a frame 14. A garment is placed on the base part 12 and then the frame 14 is lowered to fit around the base part and hold the garment firmly by the edges to the base part 12. The end 16 of the base opposite the hinge is generally shaped like a clothes hanger to hold the neck or collar of the garment. The end 16 contains a groove 18 which receives a locking pin 20 on the frame so that the frame may be locked in the closed position once a garment is inserted. A pair of springs 22 connected between the base and the frame ensure a smooth transit of the frame between open and closed positions, and may be combined with a latch, not shown, to latch the frame in the open position. The base is shaped with a groove 24 extending around the edges and corresponding to the shape of the frame, for the frame to fit when in the closed position. Thus the upper surface of the frame 14 forms a continuous surface with the top of the base or at least does not extend above the surface of the base or the garment on the base and hence does not interfere with the printer when the pallet enters the printing area.

Figure 2:
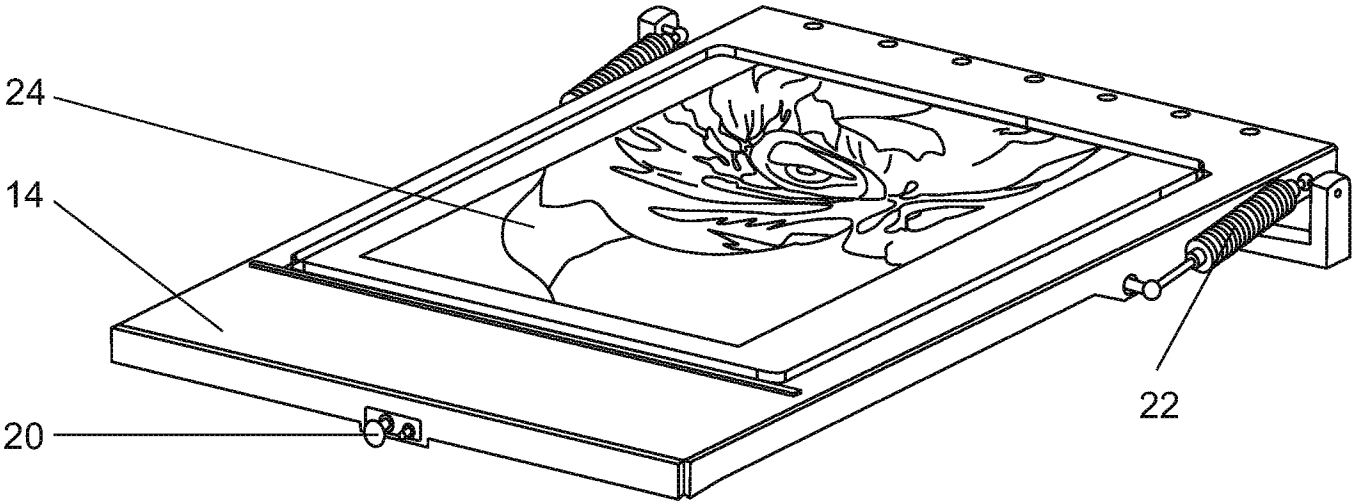
Fig. 2 Prior Art
FIG. 2 is a schematic diagram of a known pallet for holding garments during printing, here shown closed over a garment.

FIG. 2 illustrates the frame 10 of FIG. 1 in the closed position. Garment 30 has been placed on the base and the frame 14 has been closed over the garment to leave the face of one surface of the garment tightly held and exposed within the frame for printing. It is noted that as the frame is lowered into groove 24 it pulls the edges of the garment down with it, thus ensuring that the garment is tightly held. Only when the pallet is locked shut is it generally allowed to enter the printing area for printing of the garment.

FIGS. 3 and 4 are both side views of pallet 10. FIG. 3 illustrates the pallet 10 with the frame 14 locked over the base with a standard size garment inside. The locking pin 20 of the frame 14 engages the groove 18 of the base and the pallet is successfully locked.

FIG. 4 illustrates the case where a thicker garment is placed in the pallet. The frame 14 is unable to fully close due to the thickness of the garment and accordingly the locking pin 20 never reaches the groove and thus cannot lock the pallet.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Figure 5:
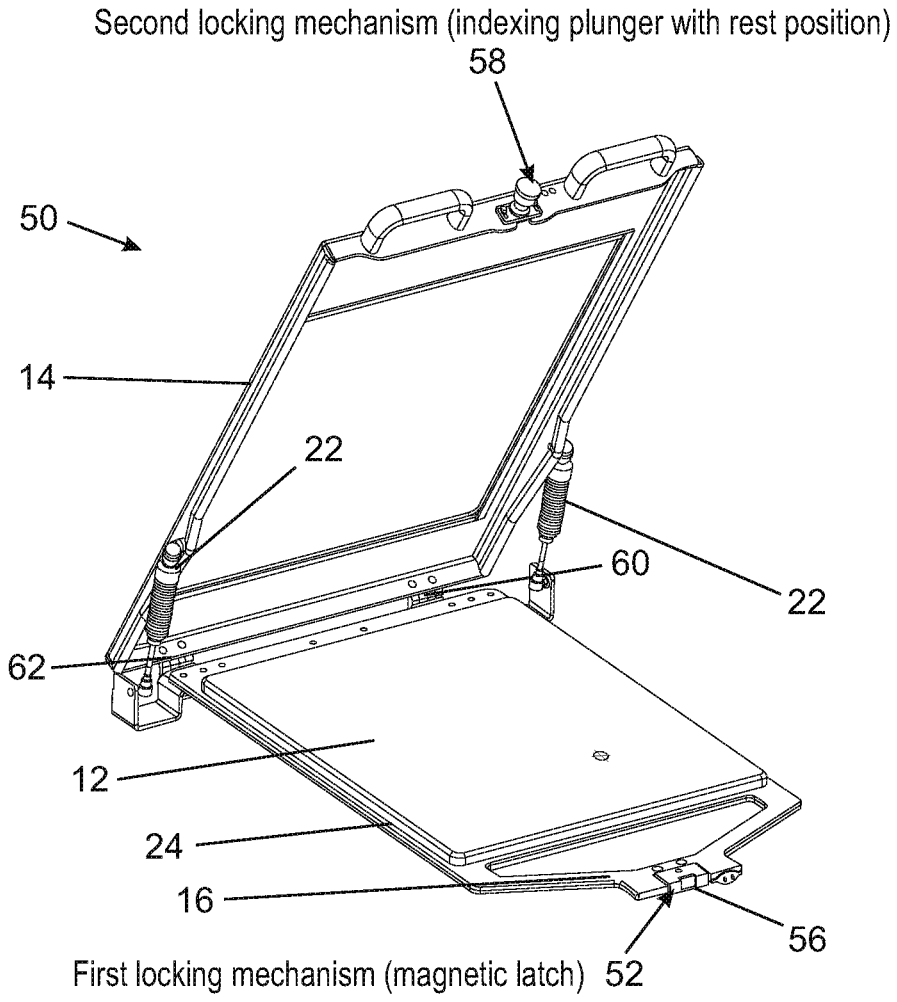
FIG. 5 is a simplified diagram showing a pallet according to an embodiment of the present invention.

Reference is now made to FIG. 5, which is a simplified diagram showing a printing pallet 50 modified according to embodiments of the present invention. As before, a base part 12 is connected via a hinge with a frame 14. A garment is placed on the base part 12 and then the frame 14 is lowered to fit around the base part and hold the garment firmly by the edges to the base part 12. The end 16 of the base opposite the hinge is generally shaped like a clothes hanger to hold the neck or collar of the garment. The end 16 contains a primary locking mechanism 52 which is made up of a magnetic latch located in the end 16 of the base. A groove 56 is located in the same position as groove 18 of the known pallet, but the groove forms part of a secondary locking mechanism. Indexing plunger 58 is located on the frame and is retained normally in a rest position as shown. However, when a thicker garment causes the primary locking mechanism to fail to engage, the indexing plunger may be pulled out of its rest position to engage with groove 56 and lock the pallet. Thus the frame may be locked shut over a thicker garment. Hence the space defined between the frame and the base is allowed to increase in size due to the secondary locking mechanism. Thus the primary locking mechanism defines a first, small space for thin garments and the secondary locking mechanism defines a second, larger space for thicker garments.

As before, a pair of springs 22 connected between the base and the frame ensure a smooth transit of the frame between open and closed positions, and may be combined with a latch, not shown, to latch the frame in the open position. The base is shaped with a groove 24 extending around the edges and corresponding to the shape of the frame, so that the upper surface of the frame 14 forms a continuous surface with the top of the base or at least does not extend above the surface of the base or the garment on the base. In embodiments some leeway is provided so that with a thinner garment the upper surface of the closed frame is below the upper surface of the base and with a thicker garment the surfaces are flush.

Thus the primary locking mechanism is designed to support thin garments, in the approximate range of 0.4-3 mm, generally covering shirts and t-shirts. The secondary locking mechanism supports thicker garments, typically in the range of 3-8 mm, and may typically be used for sweaters and hoodies.

As well as a multi-level locking mechanism on the locking side of the pallet, a multi-level hinge mechanism may be added. Hinges 60 and 62 connect the base 12 and frame 14, and a latch (not shown) may allow the hinge mountings to be moved between two or more different positions on either the base or the frame or both.

A failsafe closure sensor may be provided to ensure that the pallet is closed before the pallet is allowed to enter the printer. The closure sensor may be a dual sensor detecting locking via either of the primary and secondary closure mechanisms and using an OR gate to allow operation if either of the closure mechanisms is engaged.

In an embodiment, more than one groove may be provided in the frame, so that the secondary locking mechanism may define more than one garment thickness. Hence an even greater range of garments may be accommodated.

FIGS. 6 and 7 are views from above and from the front, and FIGS. 8A to 8C are side cutaway views, all showing the pallet of FIG. 5 and illustrating operation of an exemplary primary locking mechanism. The frame 14 includes a metal plate 64 which latches onto the magnetic latch of the primary locking mechanism. The indexing plunger 58 remains in the rest position and an approximately 2 mm space—70—is allowed for the garment. It is noted that although the space actually provided for the garment is 2 mm, garments with thicknesses up to 3 mm may be accommodated, since fabrics can be compressed.

Figure 10:
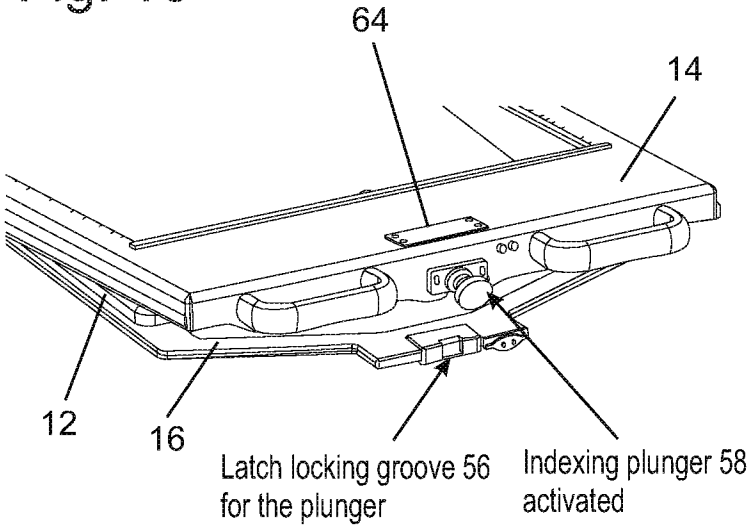
FIGS. 9, 10 and 11A-11C are different views showing operation of the secondary locking mechanism of the pallet of FIG. 5.
Figure 9:
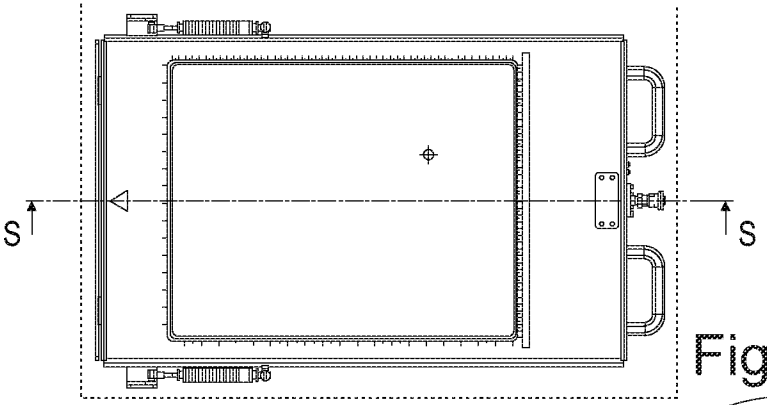
Figure 11B:
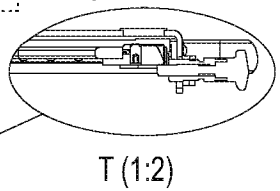
Figure 11A:
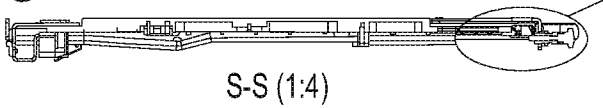
Figure 11C:
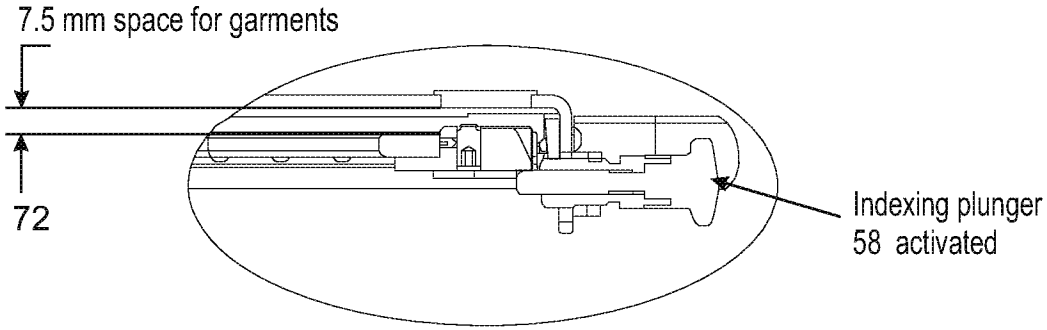

FIGS. 9 and 10 are views from above and from the front, and FIGS. 11A to 11C are side cutaway views, all showing the pallet of FIG. 5 and illustrating operation of an exemplary secondary locking mechanism. The frame 14 includes a metal plate 64 which in this case fails to attach onto the magnetic latch of the primary locking mechanism since the thickness of the garment does not allow the frame to get near enough to the base 12 for the magnetism to take effect. The indexing plunger 58 is placed in the active position and engages groove 56 at the coat hanger end 16 of the base to lock the pallet. A space 72 of approximately 7.5 mm is provided for the garment. It is noted that although the space actually provided for the garment is 7.5 mm, garments with greater thicknesses may be accommodated, since, as discussed above, fabrics can be compressed.

FIG. 12A is a perspective view of an indexing plunger 80 that may be used in the pallet of FIG. 5. FIG. 12B shows a profile of the indexing plunger 80 and FIG. 12C shows the profile after rotation by 90 degrees. Rotating the plunger allows for release of the plunger from the rest position so that it may be activated and used to lock the pallet when needed. Indexing plungers are levers with a rest position and are used where the plunger is normally expected to remain in a retracted rest position. The plunger is rotated to release from the rest position and a notch keeps the plunger in the active position until rotated back again.

Figure 13B:
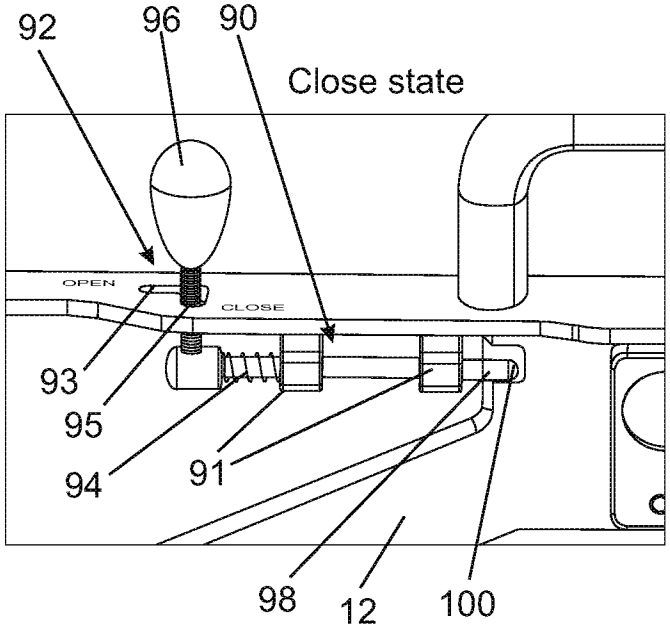
FIGS. 13A and 13B are open and locked positions of an alternative embodiment of a secondary locking mechanism according to the present invention.
Figure 13A:
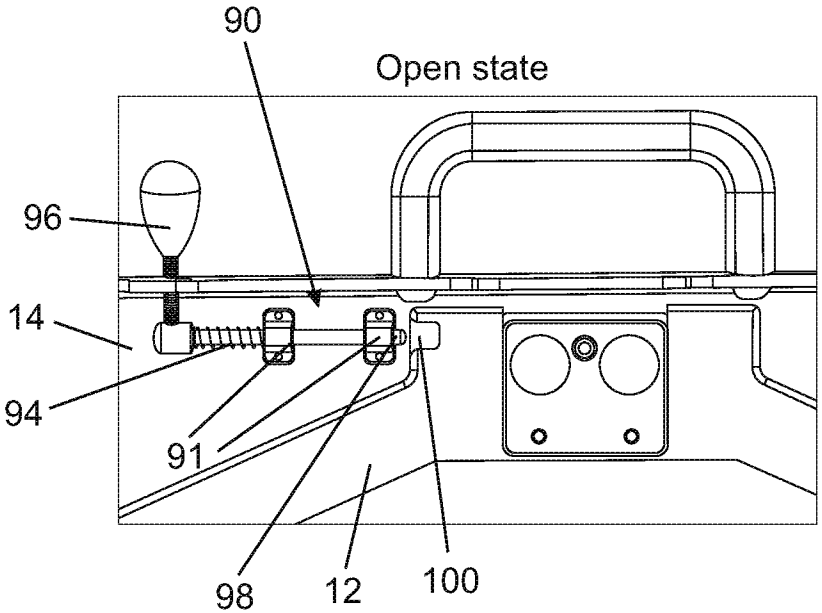

Reference is now made to FIGS. 13A and 13B which show open and closed states respectively in an alternative embodiment of the secondary locking mechanism. The primary locking mechanism may be the same as in the embodiment of FIG. 5. In the present embodiment, the lever is the handle part of a spring-loaded bolt 90, which is placed in an L-shaped groove 92 in the frame 14. The bolt 90 is slidably held to the surface of the frame 14 by two hinges 91. In the open position the bolt handle is in the base 93 of the L and spring 94 pushes the bolt handle 96 outwardly from the hinges causing bolt head 98 to remain clear of a latching groove 100 in the base.

In the closed position, the bolt handle 96 is in the upper part 95 of the L-shaped grove so that spring 94 is compressed and bolt head 98 engages groove 100 to lock the pallet shut.

In another embodiment of the invention the locking mechanism may comprise a linear ratchet mechanism. The linear ratchet provides several locking positions and thus allows a suitable locking position to be chosen by the operator based on the actual thickness of the item of clothing being printed at the time.

Figure 14:
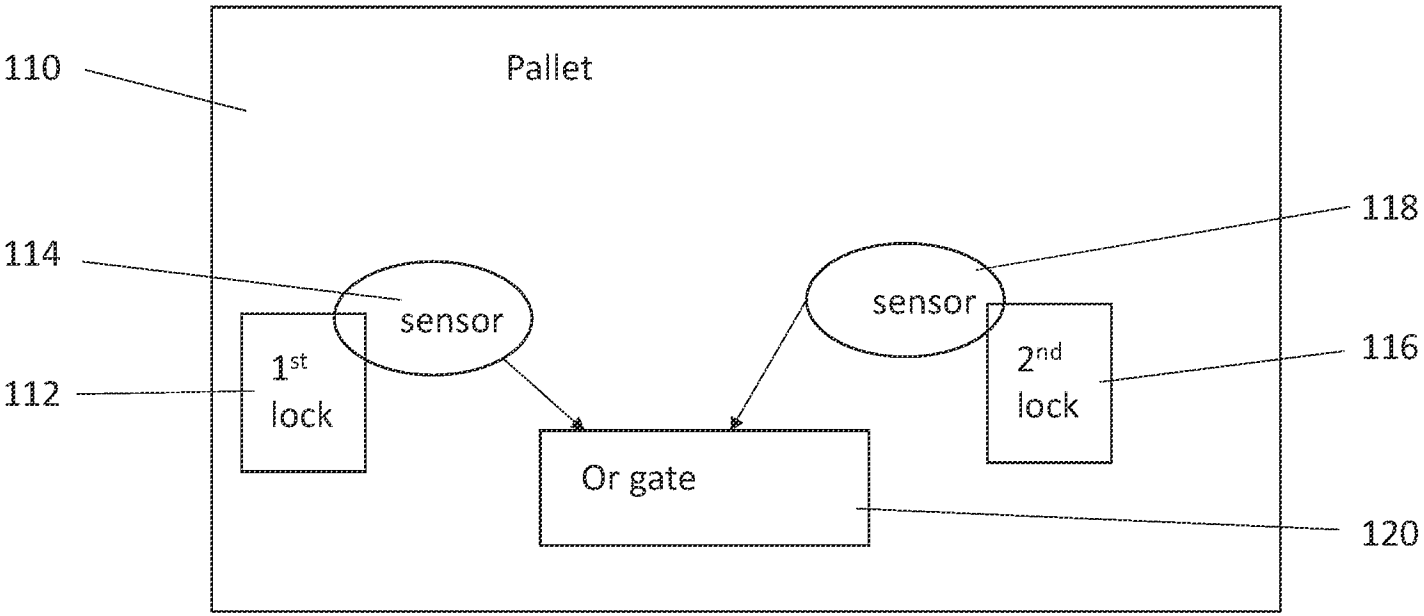
FIG. 14 illustrates a fail-safe locking sensor of the present embodiments.

Reference is now made to FIG. 14, which illustrates the fail-safe locking mechanism referred to above. A fail-safe locking sensor for detecting whether the pallet 110 is locked may be provided in order to prevent an unlocked pallet from inadvertently entering the printing area. The fail-safe locking sensor has a first sensing mechanism 114 for sensing a state of the first locking mechanism 112 and a second sensing mechanism 118 for sensing a state of the secondary locking mechanism 116. An OR gate 120 allows entering the printing area when either one of the first and secondary locking mechanisms is engaged.

The terms "comprises", "comprising", "includes", "including", "having" and their conjugates mean "including but not limited to".

The term "consisting of" means "including and limited to".

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment and the present description is to be construed as if such embodiments are explicitly set forth herein. Conversely, various features of the invention, which are, for brevity, described in the context of a single embodiment, may also be provided separately or in any suitable subcombination or may be suitable as a modification for any other described embodiment of the invention and the present description is to be construed as if such separate embodiments, subcombinations and modified embodiments are explicitly set forth herein. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

It is the intent of the applicant(s) that all publications, patents and patent applications referred to in this specification are to be incorporated in their entirety by reference into the specification, as if each individual publication, patent or patent application was specifically and individually noted when referenced that it is to be incorporated herein by reference. In addition, citation or identification of any reference in this application shall not be construed as an admission that such reference is available as prior art to the present invention. To the extent that section headings are used, they should not be construed as necessarily limiting. In addition, any priority document(s) of this application is/are hereby incorporated herein by reference in its/their entirety.

What is claimed is:

1. A pallet for holding garments during printing, the pallet comprising a base and a frame pivotally attached to said base, to hold a garment in a space between said base and said frame, said frame being locked onto said base over said garment to define said space, the pallet comprising a first locking mechanism to lock the frame into a first position defining a first sizing of said space and a secondary locking mechanism for locking the frame into a second position defining a second sizing of said space, thereby allowing for accommodation of garments of different thicknesses, the pallet further comprising a fail-safe locking sensor for detecting whether said pallet is locked to prevent an unlocked pallet from entering a printing area, the fail-safe locking sensor having a first sensing mechanism for sensing a state of said first locking mechanism and a second sensing mechanism for sensing a state of said secondary locking mechanism, and an OR gate for allowing said entering a printing area when either one of said first and secondary locking mechanisms is engaged.

2. The pallet of claim 1, wherein said first locking mechanism and said secondary locking mechanism are used as alternatives.

3. The pallet of claim 1, wherein said first locking mechanism comprises a magnetic latch and said secondary locking mechanism comprises a lever.

4. The pallet of claim 3, wherein the lever has a rest position and an active position.

5. The pallet of claim 4, wherein said lever is located on a first member of a group comprising first and second members, and a corresponding groove is located on said second member, said first and second members being said frame and said base, said lever being configured to engage said corresponding groove, said engaging being only when in said active position.

6. The pallet of claim 5, wherein said lever is configured to change between said active and said rest position by rotation.

7. The pallet of claim 5, wherein one of said frame and said base comprises a shaped groove, said lever is configured to change between said active and said rest position by guidance through said shaped groove.

8. The pallet of claim 1, wherein said first sized space is under 3 mm and said second sized space is over 3 mm.

9. The pallet of claim 1, wherein said first sized space is suitable for t-shirts and said second sized space is suitable for sweaters and hoodies.

10. The pallet of claim 1, further comprising hinges for said pivotal attachment of said base to said frame, said hinges being mounted on adjustable mounts.

11. The pallet of claim 1, wherein said secondary locking mechanism comprises a plurality of locking positions.

* * * * *